US009199180B2

(12) United States Patent
Chen et al.

(10) Patent No.: US 9,199,180 B2
(45) Date of Patent: Dec. 1, 2015

(54) LED BALLOONS

(71) Applicants: Yu Chen, Tianjin (CN); Qingting Zhang, Tianjin (CN); Miu Wong, Pokfulam (HK)

(72) Inventors: Yu Chen, Tianjin (CN); Qingting Zhang, Tianjin (CN); Miu Wong, Pokfulam (HK)

(73) Assignee: Party Dragon, Ltd., Hong Kong (HK)

( * ) Notice: Subject to any disclaimer, the term of this patent is extended or adjusted under 35 U.S.C. 154(b) by 252 days.

(21) Appl. No.: 14/045,921

(22) Filed: Oct. 4, 2013

(65) Prior Publication Data

US 2015/0009656 A1 Jan. 8, 2015

Related U.S. Application Data

(60) Provisional application No. 61/842,659, filed on Jul. 3, 2013.

(51) Int. Cl.

| | |
|---|---|
| ***A63H 27/10*** | (2006.01) |
| ***F21L 4/00*** | (2006.01) |
| ***F21K 99/00*** | (2010.01) |
| *F21W 121/00* | (2006.01) |

(52) U.S. Cl.
CPC *A63H 27/10* (2013.01); *F21K 9/00* (2013.01); *F21L 4/00* (2013.01); *A63H 2027/1058* (2013.01); *A63H 2027/1091* (2013.01); *F21W 2121/00* (2013.01)

(58) Field of Classification Search
CPC ... A63H 2027/1058; A63H 27/10; F21L 4/00
USPC ..... 362/96, 157; 116/210
See application file for complete search history.

(56) References Cited

U.S. PATENT DOCUMENTS

| | | | | |
|---|---|---|---|---|
| 7,204,740 | B2 * | 4/2007 | Petell | 446/220 |
| 7,320,529 | B2 * | 1/2008 | Goh et al. | 362/96 |
| 7,850,328 | B2 * | 12/2010 | Carito | 362/189 |
| 8,297,778 | B2 * | 10/2012 | Jeffrey | 362/189 |
| 2012/0129420 | A1 * | 5/2012 | Wu | 446/220 |

* cited by examiner

*Primary Examiner* — Karabi Guharay
(74) *Attorney, Agent, or Firm* — Gerard F. Dunne

(57) ABSTRACT

The present invention provides a LED balloon which comprises a balloon, a filler, a locking device and a LED. Wherein the locking device is on the interior of the balloon, and said filler is on the exterior of the balloon. The locking device comprises two sides which define an internal a cavity within the locking device. The filler is secured within the cavity of the locking device, thereby securing the balloon to the locking device.

A LED is connected to the locking device, providing illumination of the balloon from within.

8 Claims, 4 Drawing Sheets

LED BALLOONS

RELATED APPLICATION

This application claims priority of Chinese Application Number ZL201320389063.1, filed on Jul. 2, 2013; and claims the benefit of U.S. Provisional Application No. 61/842,659 filed on Jul. 3, 2013.

FIELD OF THE INVENTION

This invention describes a light-up balloon product, specifically a balloon with a Light Emitting Diode (LED) light source secured to the inside of the balloon.

BACKGROUND OF THE INVENTION

Balloons are used as decorations in parties, meetings and ceremonies. They can be of different sizes, shapes and colors and can have prints on their surfaces. However, these types of balloons are only visible in daytime or environments with sufficient lighting. Such requirements limit the usage of balloons.

To expand usage of balloons, U.S. Pat. Nos. 7,204,740; 7,320,529 and 7,850,328 B2 described certain LED balloons that have LED devices mounted outside the mouth (openings) of the balloons to achieve certain illumination effects that are different from regular unlit balloons. LED balloons made using these techniques are different from regular balloons and have LED devices that are rather cumbersome and complicated. U.S. Pat. No. 8,297,778 improves upon the prior devices by securing a small LED to the interior of the balloon with a clip or O-shaped band on the exterior of the balloon. The problem, however, is that it is very difficult to connect the LED devices to the skin of the balloon. The LED device of U.S. Pat. No. 8,297,778 secures to the interior of the balloon using a clip or o-ring secured around the skin of the balloon from the exterior. Such a connection is difficult for manufacturing, creates an external O-ring visible on the balloons exterior, and puts unwanted stress on the skin of the balloon.

SUMMARY OF THE INVENTION

This invention describes a new method for the LED device to be attached to a balloon. A LED device with locking device is placed inside and at the bottom of a balloon ("bottom" refers to the side opposite the opening of the balloon). The locking device contains a hinged opening which contains a hollow cavity for receiving a "Filler." The present Device uses a Filler, which can be a simple polymer bead or other small solid object. The preferred embodiment as shown in the accompanying figures uses a small spherical polymeric bead. The filler is pressed against the exterior skin at the bottom of the balloon, such that the skin of the balloon encloses the filler. The filler is than inserted into the hollow cavity of the locking device, on the exterior of the balloon. The locking device is then closed, trapping the filler and the skin of the balloon inside.

The LED device is powered by batteries. An insulating strip is provided which prevents the batteries form creating a circuit, prior to use. The insulating strip has a tab which extends through the opening of the balloon, such that prior to use, the user pulls the tab, releasing the strip, allowing the batteries to come into contact completing the electric circuit and causing the LED to light-up.

The LED and locking device will be fully concealed in the interior of the balloon, with no clamps or other parts visible on the exterior of the balloon. The balloons made from this new invention will function just like ordinary balloons, however they will have an illuminated LED on their interiors, causing the balloon to illuminate.

In short, the present LED balloon invention described in this application includes a balloon, a filler and an LED device. The LED device has a locking device that will lock the filler objects together with the skin of a balloon, making the balloon, filler object and LED device inseparable parts of a light-up balloon design.

The LED device described above contains batteries, LED lights and battery connector with a locking device. The batteries are placed inside the battery connector and are connected to LED lights through a wire or conductor. The locking device and the battery connector can be one piece (see FIGS. 1 and 2) or multiple pieces attached together (see FIGS. 3 and 4).

The locking device can be attached to the battery connector through welding, plugging or other types of bonding mechanisms. Additionally, the locking device may have a T-shaped notch, while the plastic casing for batteries has corresponding guiding rails that conform to the T-shaped notch, securing the batteries in place. The guiding rails will fit securely and snugly within the T-shaped notch.

The locking device has two parts. By closing the two parts, a cavity is formed that is capable of securing a filler and part of the skin of a balloon in place, thus securing the LED device to the interior of the balloon.

It should be understood that the LED, locking device and battery compartment can be made of a variety of materials and shapes. The materials are preferable polymeric materials such as polypropylene, polyethylene, polyvinyl chloride, polystyrene, nylon, ABS, polyester or some kinds of polyoxymethylene.

The balloon mentioned here can be a latex balloon or any other type of balloon with a soft semi-resilient surface or skin.

The filler can be a spherical, elliptical, cylindrical or other shaped filler, and be made of a metal, plastic or any other materials, though the preferred filler is a single polymeric bead.

DETAILED DESCRIPTION OF THE DRAWINGS

Figure 1:
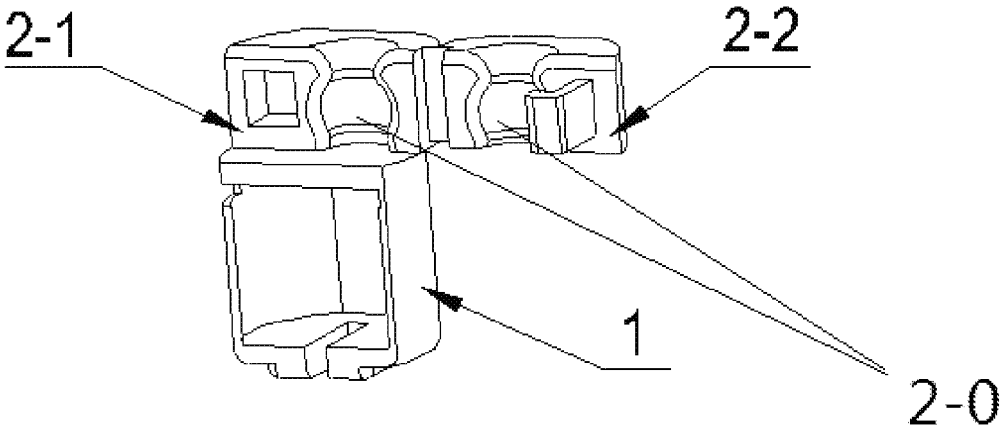
FIG. 1. An illustration of the locking device of the present invention in the open position with a battery and LED housing and a locking device in one integral piece FIG. 2. An illustration of the said invention with the locking device and LED connected to the interior of a balloon.
Figure 2:
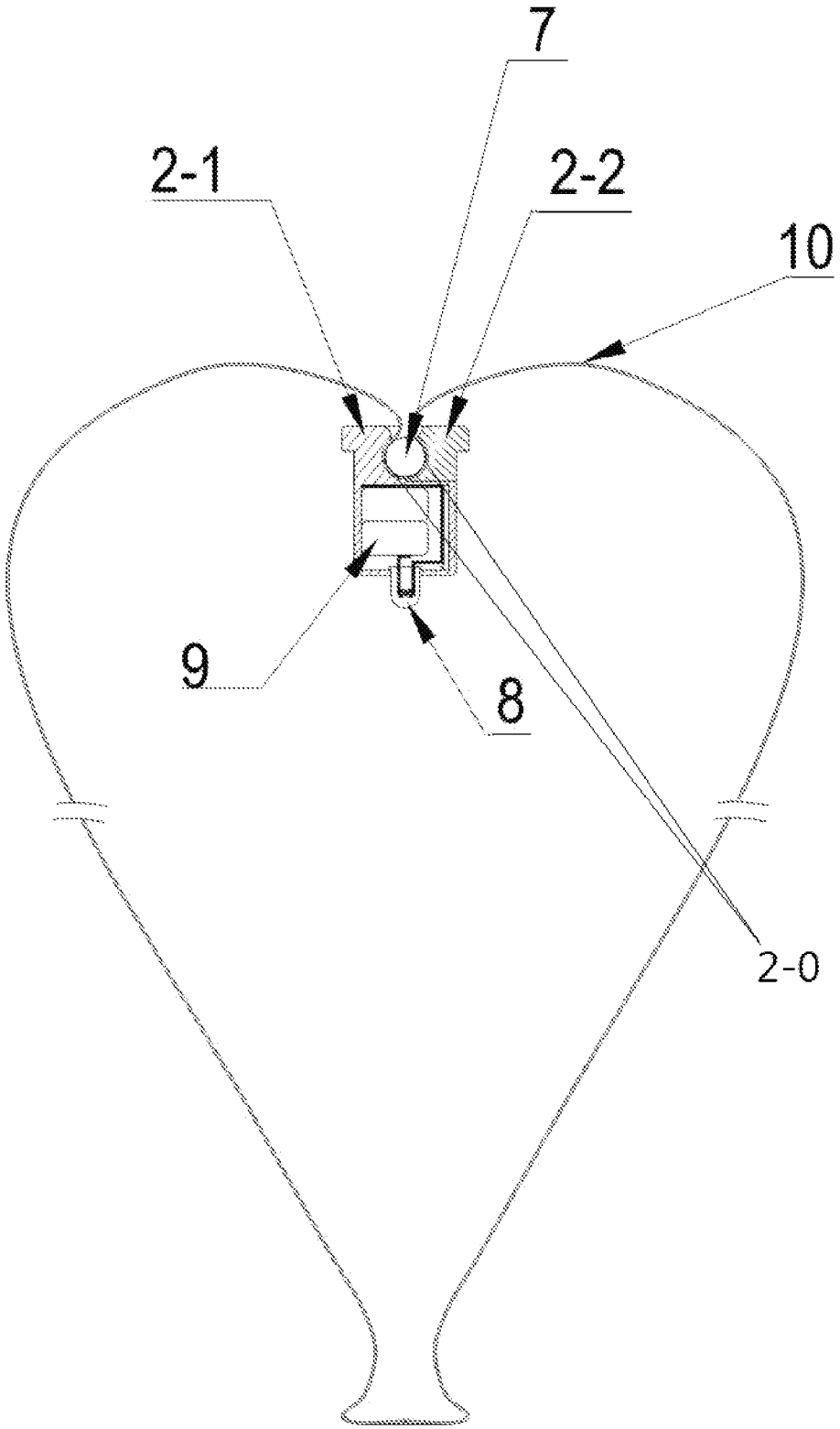

1 is the battery connector;
2-0 is the cavity of the locking device;
2-1 and 2-2 are the two mating sides of the locking device of one embodiment;
3 is battery connector;
4-1 and 4-2 are the two mating sides of the locking device of another embodiment;
5 is the T-shaped notch for securing the battery(ies);
6 is the guiding rail for securing the battery(ies);
7 is a spherical shaped filler;

8 is the LED light;
9 is the battery(ies);
10 is the balloon; and
11 is a cylindrical shaped filler One embodiment of a LED Device and balloon of the present invention (see FIGS. 1 and 2) contains a balloon (10), a filler (7) and a battery connector (1), and a locking device comprising two sides (2-1 and 2-2) and a cavity (2-0). When the locking device is secured in place to the interior of a balloon (FIG. 2), the skin of the balloon is trapped by the filler (7) inside the cavity (2-0) of the locking device, securing the entire LED device to the balloon (10).

The LED device above includes LED lights (8), batteries (9), and a battery connector (1) with a locking device [comprising a cavity (2-0), two mating sides (2-1, 2-2), and a filler (7)]. The batteries (9) are installed inside the battery connector (1) and the said LED light (8) is connected to the batteries (9) through a wire or conductor. The locking device and the battery connector (1) is one integral piece.

The abovementioned locking device consists of two mating sides (shown as 2-1 and 2-2), the closing of which form a cavity (2-0) with a small opening. The cavity will contain a filler (7) and the skin of the balloon (10), thereby securing the LED device to the balloon.

Another embodiment of an LED balloon of the present invention (see FIGS. 3 and 4) contains a balloon (10), a cylindrical filler (11) and an LED device. The LED device has a locking device. The skin of the balloon (10) is trapped by the filler inside the cavity of the locking device, thereby connecting the LED device and filler to the balloon (10)

Figure 3:
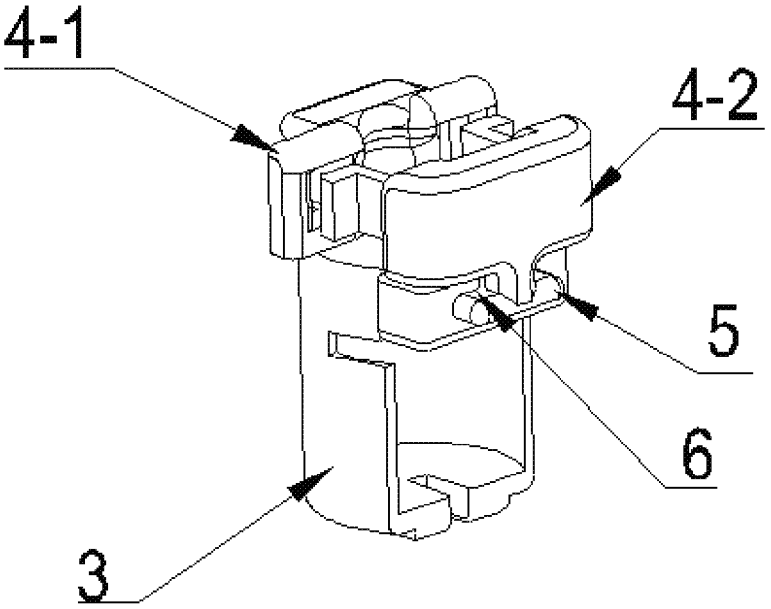
FIG. 3. An illustration of another embodiment of the battery connector and a locking device of the present invention in the closed position, secured through a mating method.
Figure 4:
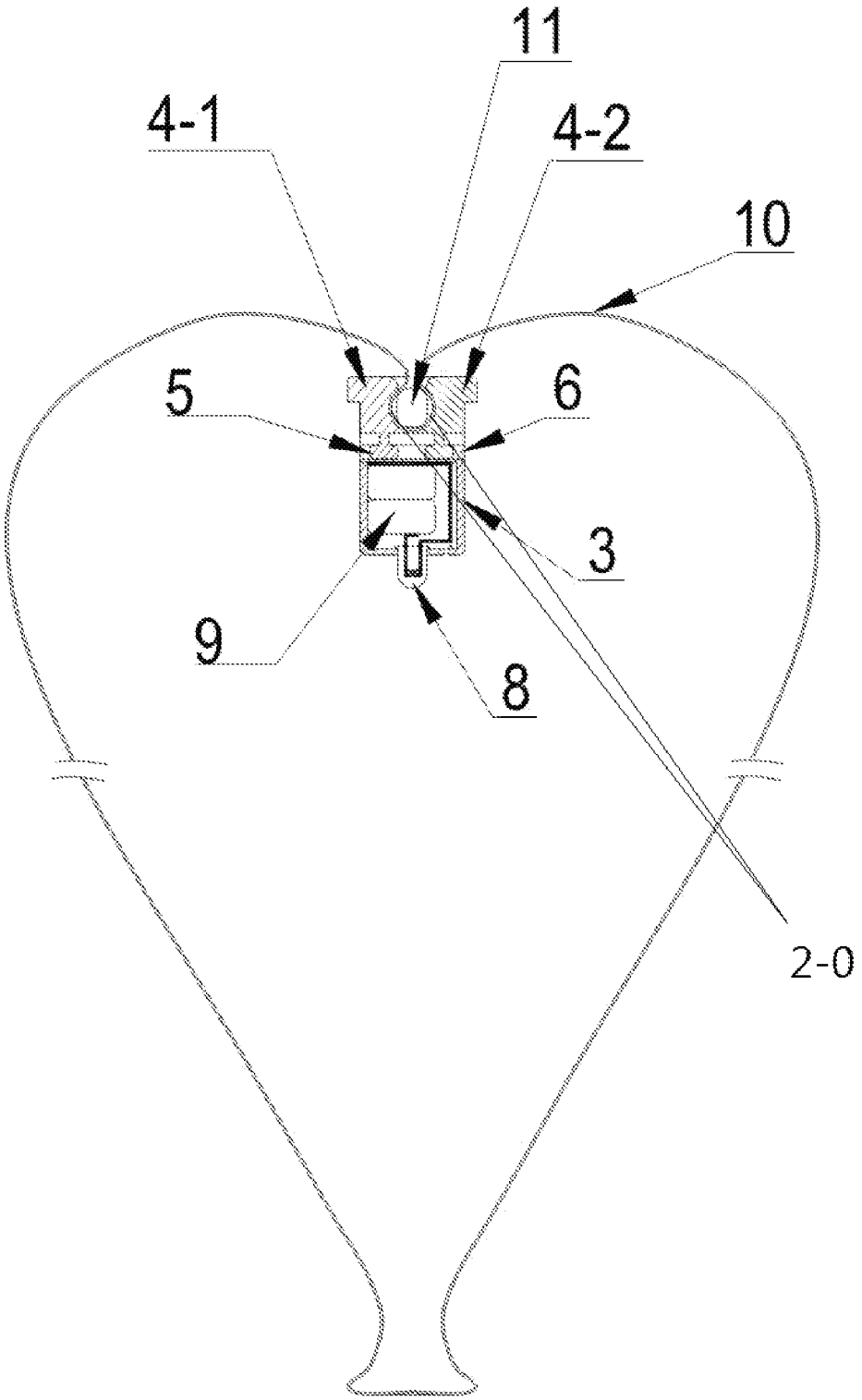
FIG. 4. A detailed illustration of the said invention with the LED device (using the battery connector shown in FIG. 3) connected to the interior of a balloon

The said LED device of FIGS. 3 and 4 includes LED lights (8), batteries (9), and a battery connector with a locking device (3). The batteries (9) are installed inside the battery connector (3) and the LED light (8) is connected to the batteries (9) through a wire or conductor. The locking device and the battery connector (3) are different pieces connected together through mating segments shown by the T-shaped notch (5) and guiding rail (6), where the T-shaped notch (5) fits securely to the guiding rail (6) on the battery connector.

The abovementioned locking device consists of two mating sides (4-1 and 4-2), the closing of which forms a cavity (2-0) with a small opening. The cavity (2-0) will contain a filler (11) and skin of the balloon (10), thereby securing the LED device and the balloon (10).

What is claimed is:

1. A LED balloon comprising a balloon, a filler, a locking device and a LED;

wherein said locking device is on the interior of the balloon, and said filler is on the exterior of the balloon; and said locking device comprising two sides, whereby said two sides define a cavity within said locking device; and said filler being secured within said cavity of the locking device, securing the skin of the balloon within said cavity, and securing the balloon to the locking device; and said LED is connected to said locking device.

2. The LED balloon of claim 1 wherein the two sides of the locking device are secured together on at least one side by a hinge.

3. The LED balloon of claim 1 further comprising an LED device;

said LED Device comprising batteries, at least one LED, and a battery connector, wherein said battery connector contains at least one battery and is secured to the locking device; and said at least one LED is connected to the battery through a wire or a conductor.

4. The LED balloon of claim 3 whereby said locking device is secured to the battery connector through welding, or any other bonding method.

5. The LED balloon of claim 3 whereby said locking device is secured to the battery connector through a mating method.

6. The LED balloon of claim 5 where the locking device comprises at least one T-shaped notch and the battery connector comprises at least one corresponding guiding rail, such that said T-shaped notch of the locking device mates securely with said guiding rails of the battery connector.

7. The LED balloon of claim 1 wherein said locking device is formed by two sides secured together to form a cavity with a small opening in the cavity directed towards the skin of the balloon; said cavity capable of receiving the filler and skin of the balloon, thereby connecting the locking device and balloon together, with the skin of the balloon exiting said cavity through said opening.

8. The LED balloon of claim 7 wherein the two sides of the locking device are secured together on at least one side by a hinge.

* * * * *